United States Patent [19]

Abercrombie

[11] 4,128,106

[45] Dec. 5, 1978

[54] GAS LIFT VALVE WITH A TENSION SPRING BIASING ELEMENT

[75] Inventor: Bolling A. Abercrombie, Montgomery, Tex.

[73] Assignee: McMurry Oil Tools, Inc., Houston, Tex.

[21] Appl. No.: 776,204

[22] Filed: Mar. 10, 1977

[51] Int. Cl.[2] ..... F04F 1/20

[52] U.S. Cl. ..... 137/155; 417/112

[58] Field of Search ..... 137/155, 537; 417/112, 417/116, 117

[56] References Cited

U.S. PATENT DOCUMENTS

| | | | |
|---|---|---|---|
| 2,651,319 | 9/1953 | Cummings | 137/537 X |
| 3,208,398 | 9/1905 | Douglas | 137/155 X |
| 3,424,099 | 1/1969 | Peters | 137/155 X |
| 3,993,129 | 11/1976 | Watkins | 137/155 X |

*Primary Examiner*—Alan Cohan

*Attorney, Agent, or Firm*—Arnold, White & Durkee

[57] ABSTRACT

A gas lift valve is characterized by a valve element biased to the first, closed, position within a valve housing by an extension spring biasing element. In the closed position the valve element interdicts communication between an annular region disposed externally to a production tubing string and the interior of the tubing string. A bellows arrangement may be provided and may have a fluid therewithin able to be pressurized to a predetermined pressure level to assist the spring biasing element in biasing the valve to the closed position. The extension spring element is disposed witin the valve housing above the bellows element. The valve element is itself physically disconnected from, but abutted against a bellows sub element which transmits the closing force to the valve element when the valve element is in the closed position. The valve element moves to the second, open, position when a combination of the forces generated by the pressure of the fluid within the annular region acting over the area of the valve seat and the pressure of a fluid within the production tubing acting over the area of the bellows arrangement are sufficient to overcome the closing force of the spring biasing element. Since the valve element is physically disconnected from the bellows sub element, the valve element interdicts communication between the annular region disposed externally to the production tubing string and the interior of the production tubing if the pressure of the fluid in the production tubing exceeds the pressure of the fluid in the annular region, thus acting as a check valve.

13 Claims, 3 Drawing Figures

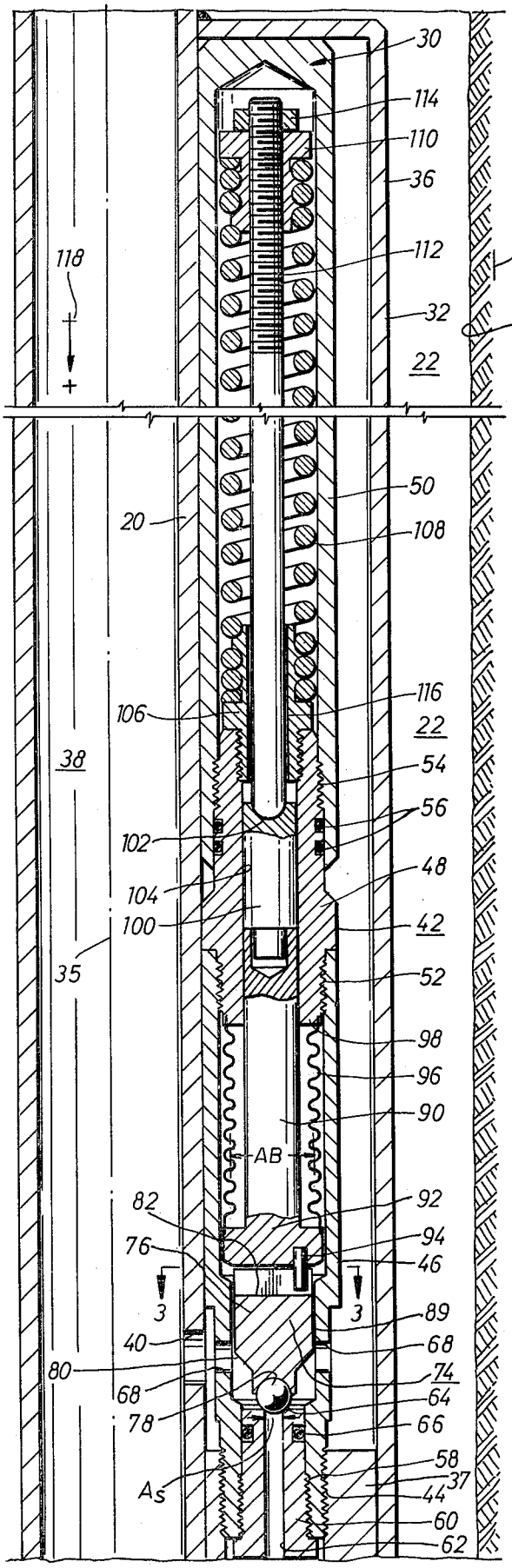
FIG. 2
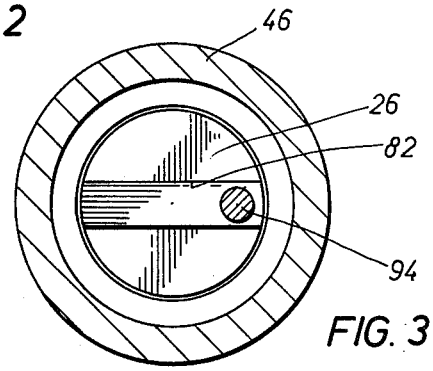
FIG. 3
FIG. 1
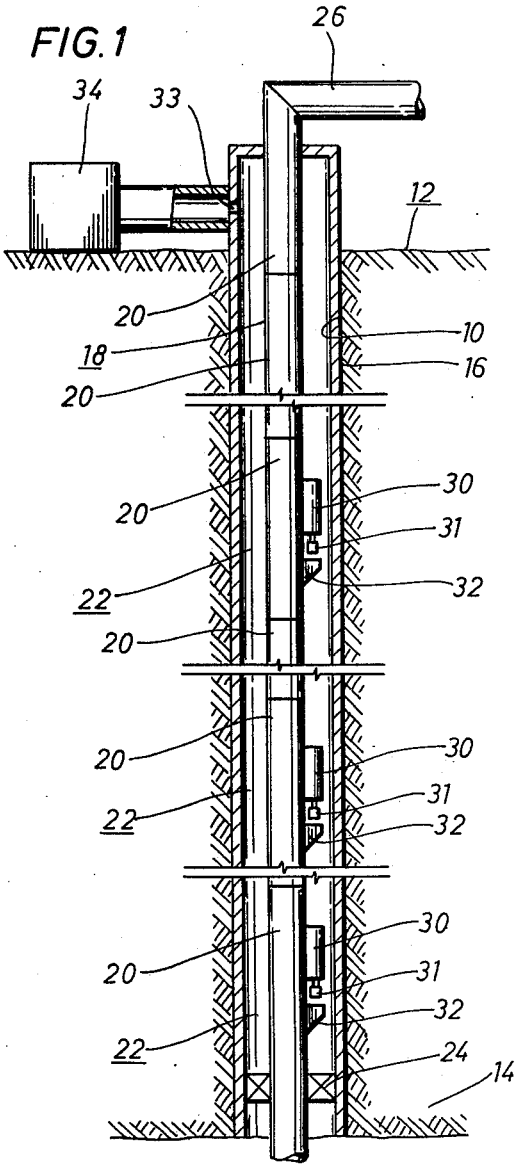

GAS LIFT VALVE WITH A TENSION SPRING BIASING ELEMENT

BACKGROUND OF THE INVENTION

1. Field of the Invention

This invention relates to gas lift valves, and in particular, to a gas lift valve utilizing an extension spring biasing element.

2. Description of the Prior Art

It frequently occurs that hydrocarbon producing wells have insufficient pressure within the particular producing formation to naturally cause the hydrocarbons contained therewithin to flow upwardly toward the surface of the earth. In order to alleviate this condition and to economically extract the maximum available quantity of hydrocarbons from the particular producing formation, the gas lift technology has been developed.

With the gas lift technology pressurized gas is introduced into the interior of the production tubing string so that fluid present therein may be lifted to the surface to thereby reduce the pressure head of the fluid and permit the natural pressure of the producing formation to urge the desirable hydrocarbons into the well bore and toward the surface. In order to introduce the gaseous lifting fluid into the interior of the production tubing string, it is common in the art to dispose a plurality of gas lift valve assemblies on the exterior of the production tubing string to regulate and control the communication between the casing annulus surrounding the string and the interior of the production tubing string.

Each of the gas lift valve assemblies is particularly adjusted to open at a predetermined desired pressure, the pressure being related to the depth of the well at which the gas lift valve assembly is disposed. The pressure at which each gas lift valve assembly is opened is regulated in the prior art by either the presence of a predetermined pressurized fluid charge within an elastic and flexible bellows element or by the biasing force imparted to the valve by a compression spring. However, each of these methods has disadvantages. For example, if a pressurized bellows is used to impart the desired biasing force to the valve assembly, it is possible that temperature effects may alter the desired set point when the valve assembly is within its operating environment within the hydrocarbon producing well. Alternatively, if a compression spring element is utilized, it commonly occurs that buckling effects are present whereby the biasing spring abrades either against the interior of the valve housing in which it is disposed or against a guide rod disposed centrally and axially through the spring element. In either case, the frictional forces attendant upon the abutment of the compression spring with another member deleteriously affects the operation of the valve assembly and makes the pressure at which that assembly will open uncertain. Further, buckling of the compression spring element and frictional contact with another member increases hystersis effects during the opening and closing cycle of the assembly and also adversely affects the spring rate thereof. The substance of such buckling imparted by compression spring biasing elements is to render uncertain the pressure at which individual gas lift valve assemblies will open and operate.

It would therefore be advantageous to provide a gas lift valve assembly which eliminates the deleterious effects attendant upon the provision of compression spring biasing elements within the gas lift valve assembly. It would also be advantageous to provide a gas lift valve assembly utilizing an extension spring biasing element to maintain a predictably accurate closing force upon the gas lift valve assembly. It would be of even further advantage to provide an extension spring biasing element which maintains the predetermined biasing force that is set within the valve before it is lowered into its operating environment in the production string.

It is also common practice in the art to dispose the compression spring biasing element in a position within the valve housing wherein the spring is exposed to the deleterious environment present within the well annulus. That is to say, the biasing spring element is usually disposed so as to be in the communication path between the exterior annulus within the well casing and the interior of the production tubing. When combined with the effects attendant upon the use of the compression spring discussed above, exposure of the spring to the deleterious environment within the operating well further detracts from the predictability and reliability of the opening and operating set point thereof.

It would be therefore advantageous to provide a gas lift valve assembly wherein an extension spring biasing element is disposed within an isolated position within the valve housing.

It is also common practice within the prior art to provide a valve seat member within the valve housing and to maintain the seat in position through the use of a snap-ring member or the like. However, such prior art valve assemblies using such a snap-ring technique to dispose the valve seat member within the housing introduces a further inaccuracy in the opening point of the valve assembly due to the movement of the valve seat when exposed to the environment in the operating well. Such movements are not predictable and not taken into account when the valve is set at its supposedly fixed opening pressure set point.

It would therefore be advantageous to provide a gas lift valve assembly utilizing a fixed seat member threadedly engaged within the valve housing to prevent displacements of the valve seat with respect to the casing when the gas lift assembly is disposed in its operating environment within a production well.

In the prior art machining inaccuracies may cause the valve element within the gas lift valve assembly to be misoriented or out of alignment with its associated valve seat. When the valve element is integrally fabricated as an element of the internal structures of the gas lift valve and directly coupled to the biasing members, such misalignments are harmful in that they necessarily introduce fluctuations into the opening pressure set point and also cause leakage through the valve. It is also common practice in the art to position a check valve either upstream or downstream of the valve closing element to prevent fluid flow between the production tubing string and the annular region when the combination of pressures is sufficient to cause the gas lift valve to assume the open position.

It is seen therefore that it would advantageous to provide a gas lift valve assembly having a floating valve element therein so that in the seated position the valve element is completely seated on its associated valve seat and thus any inaccuracies in the machining of the element or the casing do not generate further inaccuracies in the opening pressure set point or permit leakage through the valve. It is therefore advantageous to physically disconnect the valve element from the bellows sub so that the physically disconnected, floating valve element may act as a check valve to prevent a back flow by remaining seated even if the pressure of the fluid within the production tubing is sufficient to overcome the closing forces on the bellows sub and move the bellows sub to its open position.

SUMMARY OF THE INVENTION

This invention relates to a gas lift valve assembly adapted to permit communication between the interior of a production tubing string and an annular region defined between the exterior of the string and a well casing. The valve generally comprises a housing having an inlet port and an outlet port therein, the inlet port adapted to communicate with the annular region, and the outlet port communicating with the interior of the production string. In the preferred embodiment of the invention a valve seat member is threadedly connected within the valve housing and has an inlet port disposed therein. A valve element is movably disposed within the valve housing from a first, closed, position to a second, open, position with the valve element blocking communication between the inlet and outlet port when in the first, closed, position. In the preferred embodiment of the invention the valve element comprises an elongated valve stem having a ball element fixedly attached thereto, the stem and ball element being movable or floating within the interior of the valve housing. A suitable bellows sub element is provided in the interior of the housing which, in the closed position, abuts against the back end of the valve element to transmit the biasing force of an extension spring element thereto. The extension spring element is provided within an isolated section of the valve housing and prevents exposure of the spring biasing element to the deleterious environment in which the valve assembly is disposed. A flexible bellows element may be provided within the valve casing and may have a fluid pressurized to a predetermined pressure level therewithin to assist the extension spring in biasing the valve element toward the closed position. The valve stem may be notched at the back end thereof to receive an axially projecting pin provided at the forward end of the bellows sub element to thereby prevent the rotation of the valve stem within the interior of the valve housing. A gas lift valve assembly embodying the teachings of this invention is adapted to move toward the second, open, position when a combination of the forces generated by the pressure of a fluid within the annular region acting over the area of the valve seat and the pressure of a fluid within the production tubing acting over the area of the bellows arrangement is sufficient to overcome the closing force of the spring biasing element combined with the force of the pressurized fluid within the bellows if the fluid within the bellows is provided. A gas lift valve assembly embodying the teachings of this invention is also adapted to allow the valve element to remain in or move in the closed position to interdict communication between the exterior annular region and the interior of the production tubing if the pressure of the fluid in the production tubing exceeds the pressure of the fluid within the annular region, this acting as a check valve.

BRIEF DESCRIPTION OF THE DRAWINGS

The invention will be more fully understood from the following detailed description of the preferred embodiment thereof, taken in connection with the accompanying drawings, which drawings form a part of this specification, in which:

FIG. 1 is a fragmentary diagrammatic view of a hydrocarbon producing well illustrating a typical environment for a gas lift valve embodying the teachings of this invention;

FIG. 2 is an elevational view entirely in section of a gas lift valve embodying the teachings of this invention; and FIG. 3 is a sectional view taken along section lines 3—3 of FIG. 2.

DESCRIPTION OF THE PREFERRED EMBODIMENT

Throughout the following description similar reference numerals refer to similar elements in all figures of the drawings. FIG. 1 illustrates a fragmentary diagrammatic view of a hydrocarbon producing well and showing a typical environment for a gas lift valve embodying the teachings of this invention. In FIG. 1 a well bore 10 extends from the surface 12 of the earth downwardly into the vicinity of a hydrocarbon producing formation 14. The bore 10 is lined with a suitable steel casing 16 extending from the vicinity of the formation 14 throughout the entire length of the bore 10 and extending further upwardly above the surface 12. Extending centrally and axially through the casing 16 is a production string 18 comprising a plurality of end-to-end connected tubing elements 20. An annular region generally indicated by reference numeral 22 is defined between the interior of the casing 16 and the exterior of the production string 18. This annular region 22 will hereinafter be referred as the casing annulus. A packer 24 is provided to seal the casing annulus from the formation 14. The string 18 is connected at its opposite end to suitable outflow line 26 through which the hydrocarbons extracted from the formation 14 are conducted to any desired location.

In order to enhance the production capability of the formation 14 through employment of a gas lift technique well-known in principle to those skilled in the art, a plurality of gas lift valves 30, each embodying the teachings of this invention, are periodically disposed at longitudinally spaced locations along the production string 18. A check valve assembly 31 and appropriate supports 32 for the valves may be provided. For a purpose well-known to those skilled in the art, the gas lift valves 30 are set to sequentially open in response to the pressure of fluid within the casing annulus 22 and the pressure of the fluid within the production tubing string 18 to permit the pressurized fluid in the casing annulus 22 to enter the interior of the production string 18. The pressurized gas is introduced into the casing annulus by any suitable means, such as a choke opening 33 in fluid communication with a source of pressurized fluid 34. It is, of course, understood that a valve 30 embodying the teachings of this invention may also be used in connection with an annular flow gas lift technique.

Having set the general environment for a gas lift valve 30 embodying the teachings of this invention, attention is directed to FIG. 2 which is an elevational view entirely in section of a gas lift valve assembly 30 embodying the teachings of this invention. The bore 10 and casing 16 therein are, of course, symmetric about a bore axis 35, thus the opposite sides of the bore and casing have been omitted from FIG. 2. Each of the valves 30 is mounted within a mandrel housing 36 disposed on the exterior of predetermined ones of the tubing elements 20 which comprise the tubing string 18. The valve 30 is shown mounted eccentric in the housing for clarity of the drawing but it is understood that it is normally mounted axially. The interior of the tubing string is indicated in FIG. 2 by reference numeral 38. A radial port 40 is disposed within the tubing element 20 to permit communication between the interior region 38 thereof and the casing annulus 22, the communication path being regulated by the gas lift valve 30 embodying the teachings of this invention.

The gas lift valve 30 includes a substantially cylindrical valve housing 42 connected within the mandrel housing 36. The housing 42 has exterior threads 44 at the lower axial end thereof which are threaded to the mandrel housing plug 37. The mandrel housing plug 37 is normally threaded to the mandrel housing 36 but these threads are not shown for clarity. A suitable check valve arrangement (not shown in FIG. 2) can be connected to the lower end of the valve housing 42, which check valve is directly exposed to the pressurized fluid within the annulus 22. However, for our purposes, it is convenient to view the valve 30 as being directly exposed to the fluid within the annulus 22.

The valve housing 42 comprises three axially conjoined, substantially elongated tubular elements, the lowermost tubular element being defined as the valve chamber housing 46, the next axially adjacent element being defined as the spacer housing 48, and the axially uppermost element being defined as the spring housing 50. Each of the elements 46, 48, and 50 are threadedly connected, as at 52 and 54, with O-ring seals 56 being disposed between the spacer housing 48 and the spring housing 50. If desired, copper gaskets may also be disposed between the last-mentioned elements to further insure a pressure-tight seal to prevent leakage into and out of the interior of the spring housing 50.

Internal threads 58 are provided at the lower axial end of the valve chamber housing 46. The threads 58 receive an elongated valve seat member 60 securely therein. An axially extending inlet passage 62 extends through the valve seat member 60, the upper terminus of the passage 62 defining an circular valve seat 64. O-ring seals 66 insure a fluid-tight mating of the valve seat member 60 and the valve chamber housing 46. It is appreciated that provision of a threadedly engaged valve seat element avoids problems encountered in prior art valves utilizing a snap ring attachment. Such attachment is known to generate variations in the opening pressure differing from that set initially into the valve. Such problems are avoided with the rigidly attached valve seat embodied in the present invention.

As seen in the drawing, the inlet passage 62 may be taken to define the valve inlet port, the head of the passage 62 defining a valve seat area indicated diagrammatically in FIG. 2 by the reference character $A_S$. A plurality of radial ports 68 is provided through the valve chamber housing 46, the ports 68 being adapted to communicate with the interior region 38 of the production tubing 20 through the opening 40 therein.

Movably disposed within the valve chamber housing 46 from a first, closed, position illustrated in FIG. 1 to a second, open, position (not shown) is a valve element generally indicated by reference numeral 74. The valve element 74, in the first, closed, position, interdicts fluid flow passing from the casing annulus 22, through the check valve (not shown), through the inlet passage 62, through the outlet ports 68, and into the interior region 38 of the tubing 20 through the port 40.

The valve element 74 itself comprises an elongated valve stem 76 having a ball member 78 securely affixed thereto. The ball member 78 is sized to seat upon the valve seat 64 to prevent fluid passage through the inlet port 62. The valve stem 76 has frustoconical surfaces 80 presented to the interior of the valve chamber housing 46, and also has a transverse notch 82 cut into the axially upward end thereof. It is, of course, understood that the valve stem 76 may be provided in any convenient configuration. A clearance 84 is defined between the stem 76 and the interior of the valve chamber housing 46. It is seen that the top of the valve stem 76, as well as the frustoconical surface 80, is exposed to the pressure of the fluid disposed within the interior region 38 of the tubing string 20. The forces generated by the pressurized fluid from the interior region 38 acting over the last-mentioned surfaces and the interactions of those forces in the opening sequence of the valve 30 are discussed in more detail herein.

Disposed within the valve chamber housing axially above the back end of the valve stem 76 is an elongated bellows sub 90. The axially lower end of the bellows sub 90 includes an enlarged head 92 having an axially extending pin 94 thereon. The pin 94 is received within the notch 82 in the stem 76 (see also FIG. 3) to thereby prevent rotational movement of the essentially free floating valve element 74 within the valve chamber housing 46. The free floating valve element 74 insures proper seating of the ball element 78 to the seat 64. Thus, the problems generated in prior art valves having the valve element fixedly attached to the interior elements of the valve is avoided with a valve embodying these inventive teachings. In such prior art valves, if an misalignment is present between the valve seat and the interior elements, the valve element itself is prevented from positively seating and sealing the valve inlet from the valve outlet. It is also appreciated that the free-floating valve element 74 embodying by a valve in accordance with the teachings of this invention remains in or moves to the closed position to interrupt communication between the exterior casing annulus 22 and the interior region 38 of the production tubing string 18 if the pressure of the fluid within tubing string 18 exceeds the pressure of the fluid within the casing annulus, to thus be effectively operable as a check valve. This is discussed in greater detail herein.

A resilient bellows 96 is connected between the underside of the head 92 and an interior shoulder 98 of the spacer housing 48. The bellows 96 is connected at those indicated locations in a manner designed to prevent leakage of a pressurized fluid into or out of the cavity created by the bellows 96 and the housing 46. The bellows 96 defines an effective area defined by the reference character $A_B$. The forces generated by the pressurized fluid disposed in the interior or the exterior of the bellows 96 act over the effective surface area $A_B$ thereof and the interaction of these forces in the opening sequence of the valve 30 is discussed in greater detail herein.

A portion of the bellows sub 90 extends into the interior of the spacer housing 48 where it abuts against an elongated cylindrical member 100. The member 100 has a scooped upper end 102 thereon. It may be appreciated that the axially adjacent and abutting end of the bellows sub 90 and the member 100 effectively operate as a spacer member despite the physical independence of each. Hereinafter, the axially abutting members 90 and 100 will be referred to as the spacer element. As seen in the FIG. 2, a radial clearance 104 is defined between the spacer and the interior of the spacer housing 48 to thereby permit fluid communication between the interior of the bellows 96 and the interior of the spring housing 50.

Threadedly connected at the upper, interior end of the spacer housing 48 is a lower spring clip 106. The lower spring clip 106 projects upwardly into the interior of the spring housing 50 and has a spring biasing element 108 threaded thereto. The spring biasing element 108 is an extension spring threaded at its upper, second end to an upper spring clip 110. An extension spring is one wherein the force applied by the spring is created by the elongation of the spring rather than by the compresion thereof. The extension spring 108 used in this invention is not elongated past the electric limit of the material used to fabricate the spring. The upper spring clip 110 is adjustably connected to an axially extending spring rod 112, and a cap nut 114 is provided. The spring rod 12 extends through the interior of the spring biasing element 108 and passes with radial clearance 116 through the lower spring clip 106 to be received within the scooped cut-out 102 provided in the upper axial end of the spacer.

It may thus be appreciated that the extension spring 108 defines a biasing element acting to bias the valve element 74 toward the first, closed, position. Further, due to the imposition of a tensile stress thereon, the extension spring 108 does not buckle to engage or abrade against either the interior of the spring housing or the spring rod. It is common in prior art gas lift valves employing compression spring biasing elements to have buckling of the spring generate abrasion between either the interior of the housing or the spring rod to alter the spring hysteresis effects or vary the spring rate to thus render uncertain the magnitude of the biasing force imposed on the valve element. Thus, the valves in the prior art using such compressive biasing springs fluctuated as to the pressure at which the valve would open. Such fluctuations are avoided with valves utilizing the extension spring 108 embodying the teachings of this invention. By utilization of an extension spring, buckling effects, spring hysteresis effects, and higher spring rates are eliminated, all to the advantage of a valve embodying the teachings herein presented.

It is appreciated that due to the threaded engagement of the upper spring clip 110 with the spring rod 112, the tension force of the spring 108 is accurately adjustable. Still further, disposition of the biasing extension spring element 108 within a substantially isolated portion of the valve 30 prevents exposure of the biasing spring 108 to potentially deleterious well fluids present within the annulus 22. As an added feature, by disposing the extension biasing spring 108 in the spring housing 50 and physically isolated from the valve element 74, the spring 108 may be set without necessitating total dismantling of the valve, as is the case with some prior art valves. It is also appreciated that the engagement of the spring rod 112 to the spacer at the scooped cut-out 102 thereof permits the biasing force of the valve to be set without danger of torquing the bellows 96.

It is seen that the interior of the spring housing may receive a pressurized fluid, such as air, chargeable to a predetermined pressure. This pressurized fluid communicates with the interior of the bellows 96 through the defined clearances 104 and 116, to thereby provide an additional biasing force combining with the force of the extension spring 108 to maintain the valve element 74 in the first, closed, position. The interactions of these closing biasing forces is analyzed in more detail herein. It is also apparent that there need be no pressurization of the fluid within the bellows 96, if desired.

OPERATION

Having thus defined the structure of a gas lift valve 30 embodying the teachings of this invention, the operation thereof is now explained. For convenience, the magnitude of the fluid pressure within the annular region 22 is defined as $P_A$, the magnitude of the fluid pressure within the interior region 38 of the tubing 20 is defined as $P_T$, and the magnitude of the pressure of the fluid within the bellows (if any) is defined as $P_B$. Forces acting in a downstring direction, that is, acting to keep the valve element 74 in the first, closed, position, are defined as positive, as indicated in FIG. 2 by the reference arrow 118.

It may be appreciated that the force of the extension biasing spring, $F_S$, acts in a positive direction on the valve element 74. Similarly, the magnitude $P_B$ of the fluid pressure within the bellows 96 (if any), acting over the effective area $A_B$ of the bellows, assists the spring force $F_S$ in seating the valve element 74. Further the magnitude $P_T$ of the fluid pressure within the tubing 20, acting over the top of the valve element 76, also assists in seating the valve element. However, it is appreciated that the same fluid pressure $P_T$ acts in an upward, or opening direction on the frusto-conical surfaces 80 of the valve stem 74. Thus, the fluid pressure $P_T$ effectively acts in a downward or closing direction on the valve element 76 over an area effectively equal to the area of the valve seat $A_S$. The fluid pressure $P_T$ also acts in an upward direction over an effective area $A_B$ of the bellows 96. And, of course, the fluid pressure $P_A$ within the annulus 22 acts over an area $A_S$ of the valve seat 64.

Summing forces, it is seen that:

$$(P_A - P_T)(A_S) + P_T A_B = F_S + P_B A_B \quad (1)$$

From this relationship it is apparent that the valve 30 moves to the second, open, position, when the combination of the forces generated by the pressure $P_A$ of the fluid within the annulus 22 and the pressure $P_T$ of the fluid within the production tubing acting over the area $A_S$ of the valve seat 64 and the area $A_B$ of the bellows 96 overcome the closing, biasing force of the spring (in combination with the bellows pressure $P_B$, if any) to move the valve element to the second, open position.

Rearranging equation (1) as follows $$(P_A - P_T)(A_S) = F_S = P_B A_B + P_T A_B \quad (2)$$

where $P_T A_B$ is equal to or greater than $F_S + P_B A_B$, the right-hand side of equation (2) is equal to zero or is negative. Thus, if $P_T$ is greater than $P_A$, the force holding the valve element 76 in the closed position is $(P_T - P_A)$ thus preventing a backflow and enabling the valve element to in effect operate as a check valve.

While a particular embodiment of the invention has been shown and described, it will be understood that the invention is not limited thereto, since many modifications may be made and will become apparent to those skilled in the art.

What is claimed is:

1. A gas lift valve adapted to permit communication between the interior of a production tubing string and an annular region defined between the exterior of the string of a well casing comprising:

a valve housing having an inlet port and an outlet port adapted to permit communication between the annular region and the interior of the production tubing string;

a hollow spring housing removably connected at one end of the valve housing, the interior of the spring housing defining a spring chamber therein, the spring chamber being physically isolated from the inlet and outlet ports;

a valve seat fixedly connected to the valve housing adjacent to the inlet port;

a valve element longitudinally and radially movable within the housing from a first, closed, position to a second, open, position, the valve element in the first, closed, position blocking communication between the inlet and the outlet;

a spacer extending through the valve housing, the spacer being disconnected from and physically independent of the valve element yet adaptable to abut the valve element to transmit a biasing force thereto; and, a tension spring disposed within the spring chamber and adapted to generate a biasing force transmissible through the spacer to the valve element to bias the valve element toward the closed position.

2. The gas lift valve of claim 1, wherein the valve element comprises a valve stem having a ball element securely affixed thereto, the ball member being received on said valve seat when the valve element is in said first closed position.

3. The gas lift valve of claim 1, wherein the valve element has a notch cut therein and the spacer has an extending pin thereon adapted to engage the notch to prevent rotation of the valve element with respect to the spacer.

4. The gas lift valve of claim 1, wherein the valve seat member is threadedly engaged within the valve housing.

5. The gas lift valve of claim 1, further comprising means for selectively adjusting the tension force within the biasing spring.

6. The gas valve of claim 5, wherein the adjusting means includes a clip secured to the spring and a spring rod extending through the valve housing and in an abutting relationship with the spacer, the clip being threadedly movable with respect to the rod to vary the tension force in the spring and imposed on the valve element through the spacer.

7. The gas lift valve of claim 1, further including a bellows arrangement disposed between the spacer and the valve housing and wherein the valve element is moved to the second, open, position when the combination of the forces generated by the pressure of the fluid within the annular region acting over the area of the valve seat and the pressure of a fluid within the production tubing acting over the area of the bellows arrangement are sufficient to overcome the biasing force of the spring element.

8. The gas lift valve of claim 1, further comprising a bellows arrangement flexibly mounted on the spacer element, the bellows having a fluid disposed therein chargeable to a predetermined pressure and exerting a predetermined biasing force on the valve element to assist the spring in biasing the valve element toward the first, closed, position.

9. The gas lift valve of claim 8 wherein the valve element is moved to the second, open, position when the a combination of the forces generated by the pressure of the fluid within the annular region acting over the area of the valve seat and the pressure of a fluid within the production tubing acting over the area of the bellows arrangement are sufficient to overcome the combined closing forces of the biasing spring and the pressurized fluid within the bellows.

10. The gas lift valve of claim 1, wherein the valve element is movable to the first, closed, position when the pressure of a fluid in the production tubing is greater than the pressure of a fluid in the annular region to thereby permit the valve element to be operable as a check valve.

11. The gas lift valve of claim 1 wherein the spring is fixed at one end thereof to the valve housing such that a tension force applied to the other end of the spring generates a biasing force therein, and further comprising:

a spring rod disposed centrally and axially of the valve housing, the spring rod being connectable to the second end of the spring and adapted to abut against the spacer so that the biasing force generated by the application of a tension force to the spring is transmissible through the spring rod to the spacer.

12. The gas lift valve of claim 11 wherein the end of the spring rod is rounded and the end of the spacer is scooped to receive the end of the spring rod, the spring rod being rotatable with respect to the spacer.

13. The gas lift valve of claim 1, wherein the valve housing has an upstring and a downstring end defined in correspondence to the production tubing string and wherein the spring housing is disposed above the valve housing in an upstring direction.

* * * * *

UNITED STATES PATENT OFFICE

CERTIFICATE OF CORRECTION

Patent No. 4,128,106 Dated December 5, 1978

Inventor(s) Bolling A. Abercrombie

It is certified that error appears in the above-identified patent and that said Letters Patent are hereby corrected as shown below:

Column 3, line 57, "in" should read --to--.

Column 7, line 13, "compresion" should read --compression--;
line 14, "electric" should read --elastic--;
line 18, "12" should read --112--.

Column 8, line 51 "$(P_A - P_T)\ (A_S) = F_S = P_B A_B + P_T A_B$" should read--$(P_A - P_T)\ (A_S) = F_S + P_B A_B - P_T A_B$--.

Column 9, line 29, "said" (both occurrences) should read --the--.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*